US009949337B2

(12) United States Patent
Conti

(10) Patent No.: US 9,949,337 B2
(45) Date of Patent: Apr. 17, 2018

(54) STAGE LIGHTING DEVICE WITH A CONTROLLING COMPUTER AND A SEPARATE OFFLINE COMPUTER

(71) Applicant: Chris Conti, North Bergen, NJ (US)

(72) Inventor: Chris Conti, North Bergen, NJ (US)

(73) Assignee: Production Resource Group, LLC, New Windsor, NY (US)

( * ) Notice: Subject to any disclaimer, the term of this patent is extended or adjusted under 35 U.S.C. 154(b) by 573 days.

(21) Appl. No.: 13/706,183

(22) Filed: Dec. 5, 2012

(65) Prior Publication Data

US 2013/0162170 A1 Jun. 27, 2013

Related U.S. Application Data

(60) Provisional application No. 61/567,573, filed on Dec. 6, 2011.

(51) Int. Cl.
*H05B 37/02* (2006.01)

(52) U.S. Cl.
CPC ..... *H05B 37/02* (2013.01); *H05B 37/0254* (2013.01); *H05B 37/0272* (2013.01)

(58) Field of Classification Search
CPC H05B 37/02; H05B 37/0209; H05B 37/0218; H05B 37/0227–37/0281; H05B 37/029; H05B 33/0863; H05B 37/0254; F21W 2131/406; F21Y 2101/02
USPC ..... 315/291
See application file for complete search history.

(56) References Cited

U.S. PATENT DOCUMENTS

2008/0297070 A1* 12/2008 Kuenzler ..... H05B 37/0272 315/308
2009/0085500 A1* 4/2009 Zampini, II ..... H05B 33/0857 315/297
2010/0180040 A1* 7/2010 Friedman ..... H04L 63/10 709/229
2010/0204841 A1* 8/2010 Chemel et al. ..... 700/282
2012/0242506 A1* 9/2012 Nguyen ..... H05B 37/029 340/907

OTHER PUBLICATIONS

Acer Incorporated, Aspire 9810/9800 Series User's Guide, Dec. 2006.*
Hewlett-Packard Company, HPvp17 LCD Monitor Users Guide, 2008.*

* cited by examiner

*Primary Examiner* — Patrick Chen
(74) *Attorney, Agent, or Firm* — Law Office of Scott C Harris, Inc

(57) ABSTRACT

A lighting device or lighting associated device which includes an off-line computer in addition to the controlling computer. The off-line computer is one that uses less power, but is accessible wirelessly even when the light is off-line and not receiving power. The off-line computer can be used to update the program and/or media that is stored in the lighting device.

5 Claims, 2 Drawing Sheets

STAGE LIGHTING DEVICE WITH A CONTROLLING COMPUTER AND A SEPARATE OFFLINE COMPUTER

This application claims priority from provisional application No. 61567573, filed Dec. 6, 2011, the entire contents of which are herewith incorporated by reference.

BACKGROUND

Today's lighting systems often include multiple different pieces of equipment which are connected together in a number of different ways. For example, a stage lighting system may include lights and props, a number of trusses, winches, and other devices which operate together in a specified way.

It is important to be able to access and support these devices. However, while stage lighting devices are usually collected to local networks, they can usually be reached only within that network. This means that if there is a problem with the device, the device has typically been individually addressed by a technician. This may make these devices relatively labor intensive to service.

Moreover, the only way that these devices can be used effectively is to provide electrical power to them. Therefore, they have only been testable when actually powered up and installed. When not powered, there is no way to test them, or even to see where they are. This means that when the device is not used for a period of time (e.g., on a shelf somewhere in storage), there has been no way to update the software or to test the collection of settings.

SUMMARY

The present application recognizes, however, that in many devices such as stage lighting devices, the device spends the majority of its time unpowered and unconnected. Moreover, even when connected, devices of this type are very often being used as part of a light show or a test for a light show. This is a very poor time to carry out maintenance operations.

BRIEF DESCRIPTION OF THE DRAWINGS in the drawings:

FIG. 1 shows a block diagram of the lighting device including a second computer associated there with.

DETAILED DESCRIPTION

The present application includes a special "package" that is formed of a processing device (e.g., a programmed processor as described herein or a microcontroller) and a battery source. The device is programmed to operate independently of a stage lighting device with which it is associated. The device operates both when the stage lighting device is on and when it is off however, the intent is for the device to operate when the stage lighting device is not receiving power, but rather is sitting waiting to be hooked up.

During times when the stage lighting device is powered over the power connection 171, the package may also accumulate various kinds of information. The information that is storage can include faults, total lamp on time, and others. An authorized user can communicate with the device, to get information, or to provide information. The communication to the device can use the local ethernet or wireless ethernet in a location local to the device. However, there is also a cellular communicator 130, allowing communication when the device is not powered or not in communication with the local network.

Figure 1:
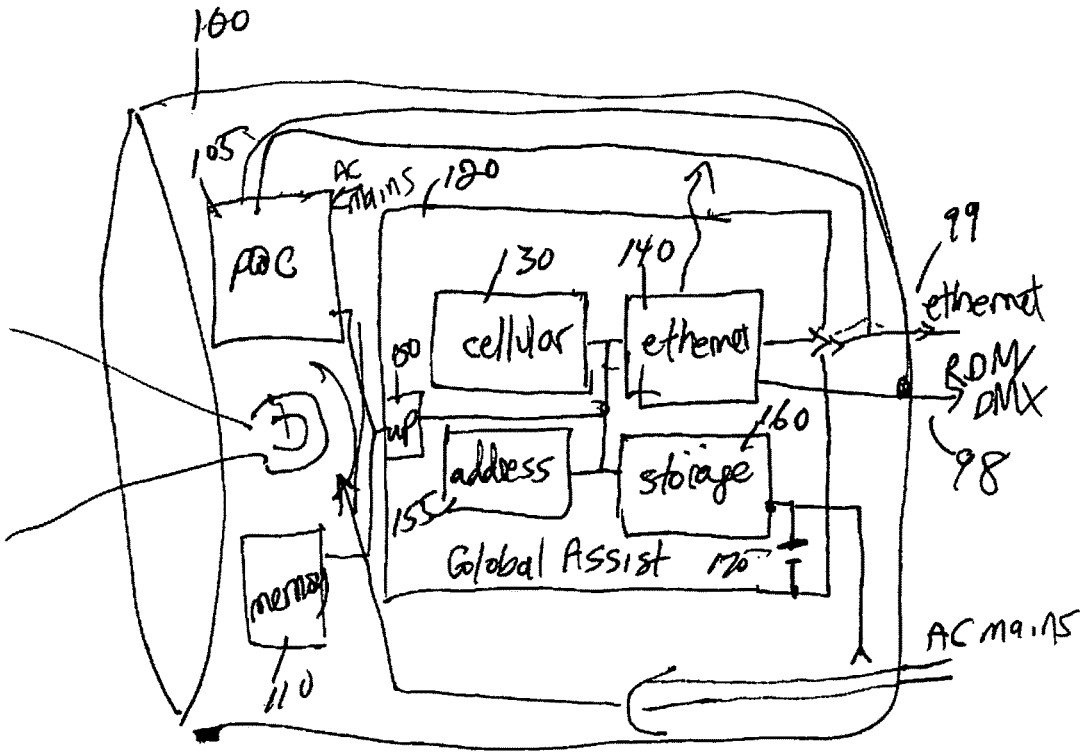

FIG. 1 shows the global assist device 120 as including a number of different parts on a circuit board. The lighting device itself includes processor 105 and memory 110 which can be nonvolatile operating memory or a hard drive. Connections are provided to a local Ethernet connection 99 and/or local RDM or DMX connection 98. the processor 150

The PRG Global Assist Package 120 includes an embedded GSM 3G/4G cellular card 130, a wireless network 802.11 card 140 that can connect to either a wired ethernet 99 and or wireless ethernet, and support software. The support software can be run by a microprocessor 150. The device includes a unique address shown as 155, and also includes mass storage capability 160 such as a hard drive or solid-state drive to enable storage of certain kinds of information. According to an embodiment, block 155 may be a smart card to facilitate high-level encryption to prevent someone from "hacking" into the lighting device. A battery 170, for example a laptop battery, may be used to provide power to the global assist device 120 when the stage light device 100 is not otherwise powered. When the stage light device 100 is powered by the power connection 171, the power to the device may charge the battery 170. The processor 150 is intended to operate when the device is not being powered by external power on connection 171 although it also can operate when external power is applied. In contrast, the processor 105 in the lighting device operates only when the device is receiving external power. According to an embodiment, processor 150 is a low-power processor that has a lower power consumption than processor 105, to facilitate the operation from battery 170.

In another embodiment, level of the power on the battery 170 is monitored by the processor, for example via a periodic wake up. When the level in the battery is low, and the device is not receiving external power, this may cause a periodic sound to be emitted from the light. For example when these devices are located on a shelf in a warehouse this may facilitate warehouse workers recharging the battery.

The Global Assist Package operates in the equipment in a "passive" or "dormant" state until activated by a technician or by any incoming communication. Incoming communication may require a very specific password which can be stored for example in the memory 110. Depending on signal strength and reception when activated, support personnel can "dial in" to the equipment via the cell or wifi cards. Once connected, support personnel can use the system to carry out various functions in the light.

Once dialed in, the support personnel can detect the operating status and health of both the device 100, and the global assist device itself 120. The light itself usually operates using a system processor 105, which stores information about its health. The system can also access and download settings and reconfigure settings. For example, this can enable the light to be preconfigured in a certain way prior to it being powered on.

Support personnel can also verify software load and configuration. For example, either different versions of the software or more updated versions of the software can be verified and loaded. In one embodiment, a special key may be set in the storage 160 to automatically require the new software to be downloaded and loaded when the device is powered on.

In another embodiment, the software may actually be uploaded to the storage unit 160, and the processor and memory forced to update from the downloaded software on power on.

In yet another embodiment, the downloaded storage information can be stored in storage 160, and used to patch the current software for example as resident in the memory 110.

Another embodiment that enable verifying and enabling license keys. For example, the software may be licensed only, and may require periodic re-verification. In one embodiment, when the stage units are sold as "scrap", a signal can be sent via the global assist device 120 which either wipes the program and memory 110, and/or which forces the system into a non-operational state so that the light cannot be used even if the program is reloaded into the memory 110.

Another feature Can Download showfiles for use by the device 100. For example, if the device is going to operate from show files or cues, those cues can be pre loaded into the storage unit 160, and/or into the memory. Again this enables pre-configuring the light. Again when the light is first powered up, it will have been pretested and configured, and no configuration of power of time is needed.

The device can also be used to access and download onboard logs. It can be used to view and record raw data transmissions like Artnet/DMX/RDM/DMX Encoder Values within the device 100. It can be used to sniff out connected devices via RDM or other Ethernet protocols. It can be used to reconfigure connected devices via RDM or other Ethernet protocols.

in a similar way, video content can be uploaded or downloaded into the device, for use in a later show for which the light is intended to be used later.

For example, an inventory control can indicate that 10 different lights or media servers or other lighting type devices will be used as part of a show. Each of those devices may be uniquely identified, to be used as part of the show. These units may be sitting on a shelf in a warehouse, however.

In conventional lights, when those lights were first connected and powered on, technicians would have to determine the content of those devices including whether there is up-to-date software, whether the right show controls and cues are located, and the like. In this system, the devices can be reconfigured while they are still on the shelves, and have been identified, but not yet taken off the shelf. When the lights are pulled off the shelf and put into service, then, they have been preconfigured, and should come up with the proper program and/or content for the show such as media files. This might be used to determine whether the devices have the most up-to-date software and whether it has most up-to-date media files, or whether it has the collection of media files that will be used by the light during its next operation. The assist device also receives other items of media to be stored in the lighting device during a time when said lighting device does not have power applied thereto.

In other embodiments, the global assist device 120 can be used in any stage lighting or stage assisting device, including: Lighting Consoles, Scenic Control Equipment, Media Servers, LED Video Wall Processors, Ethernet Switch Gear, and/or a Power Distro.

For media servers, determinations can be made of whether the devices have the right and/or complete video content. The test can determine whether they have show files and effects of the type that are needed. In conventional lights, this could not be ascertained until the device was first powered up and communicated with. Typically, these devices were not powered up until after they were installed on the trusses. That would require, therefore, that the show be set up before the technician knew the status of the light.

However, the global assist device can enable determining this when the devices are not connected to power. For example this can create an indication saying that device one needs a software update, and needs files X1-X10. The files may be downloaded, or may be marked for download at the next power up so that the battery is not depleted. In this way, the technicians know prior to installing and setting up the light, what will need to be done to that light prior to using it as part of the show.

Figure 2:
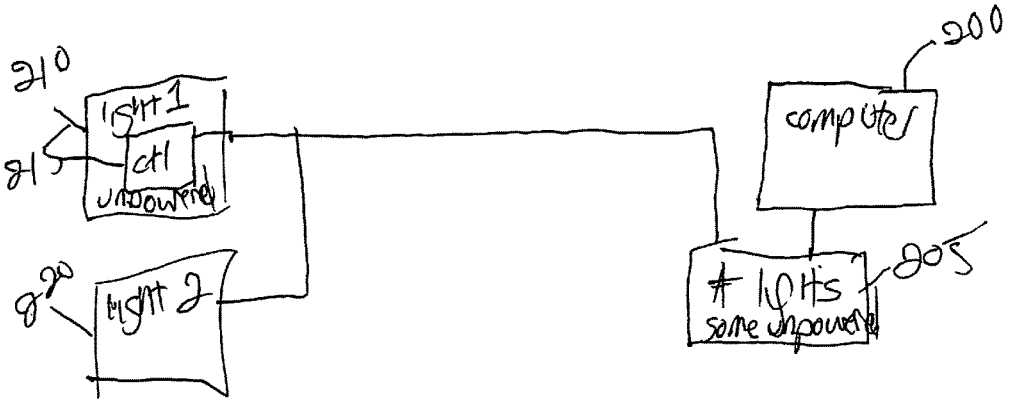
FIG. 2 shows a system of programming a light show.

A method of configuring a light is also disclosed. That method comprises creating a light show on a computer 200, by specifying a number of lights to be used in the light show, shown as 202 in FIG. 2. At least some of said lights are unpowered and being remote from the light show computer. That computer 200 is used for automatically configuring characteristics of the number of lights including those lights that are unpowered, by communicating with the unpowered lights. The communicating can provide a software update to the unpowered lights, and/or can provide media to the unpowered lights.

Dependent on the equipment installed in, the Global Assist Package can additionally enable end users to access user information as well as enable backup online storage in the mass storage 160. For example, the storage 160 may store various kinds of information about the device for download. This can allow download of user manuals, download profiles, download configuration files, back up showfiles, back up configurations as well as storage of computer drivers.

The Global Assist Package can also support a training mode. In this training mode, clients can activate the Global Assist Package and support personnel can "walk" clients through using the equipment by hi-lighting button presses and activating menus.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other kinds of information can be stored in the system.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments.

The various illustrative logical blocks, modules, and circuits described in connection with the embodiments disclosed herein, may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. The processor can be part of a computer system that also has a user interface port that communicates with a user interface, and which receives commands entered by a user, has at least one memory (e.g., hard drive or other comparable storage, and random access memory) that stores electronic information including a program that operates under control of the processor and with communication via the user interface port, and a video output that produces its output via any kind of video output format, e.g., VGA, DVI, HDMI, display port, or any other form. This may include laptop or desktop computers, and may also include portable computers, including cell phones, tablets such as the IPAD™, and all other kinds of computers and computing platforms.

A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein.

The steps of a method or algorithm described in connection with the embodiments disclosed herein may be embodied directly in hardware, in a software module executed by a processor, using cloud computing, or in combinations. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of tangible storage medium that stores tangible, non transitory computer based instructions. An exemplary storage medium is coupled to the processor such that the processor can read information from, and write information to, the storage medium. In the alternative, the storage medium may be integral to the processor. The processor and the storage medium may reside in reconfigurable logic of any type.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer.

The memory storage can also be rotating magnetic hard disk drives, optical disk drives, or flash memory based storage drives or other such solid state, magnetic, or optical storage devices. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media. The computer readable media can be an article comprising a machine-readable non-transitory tangible medium embodying information indicative of instructions that when performed by one or more machines result in computer implemented operations comprising the actions described throughout this specification.

Operations as described herein can be carried out on or over a website. The website can be operated on a server computer, or operated locally, e.g., by being downloaded to the client computer, or operated via a server farm. The website can be accessed over a mobile phone or a PDA, or on any other client. The website can use HTML code in any form, e.g., MHTML, or XML, and via any form such as cascading style sheets ("CSS") or other.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A computer-controlled lighting device, comprising:

a lighting device, producing a light output;

said lighting device including a lighting-controlling computer part, said lighting-controlling computer part controlling said light output, said lighting-controlling computer part communicating over a network and receiving signals over the network, said lighting device including a memory that stores a controlling program for the lighting device, and said lighting-controlling computer part operating when said lighting device has external power applied thereto, said lighting-controlling computer part operating based on said external power for accessing a lighting program stored in said memory, and operating said lighting device based on said lighting program stored in said memory, and said lighting-controlling computer part not operating while said lighting device does not have said external power applied thereto;

an assisting computer part, operable when said lighting device does not have the external power applied thereto and the lighting-controlling computer part is not operating, said assisting computer part including a battery, and a wireless communicator, powered by said battery, wherein said assisting computer part is operated based on power from said battery and accesses said lighting program stored in said memory, and provides information about said lighting program over said wireless communicator when said lighting device does not have the external power applied thereto, said information about said lighting program including information about a program that will control operation of the lighting device, and information about a revision of software that operates said lighting device, both of said information about the program that will control operation of the lighting device, and said information about the revision of software that operates said lighting device are provided over said wireless communicator, and where said lighting-controlling computer part does not operate from said power from said battery.

2. The device as in claim 1, wherein said assisting computer part receives a software update during a time when said lighting device does not have said power applied thereto and the lighting-controlling computer part is not operating.

3. The device as in claim 1, wherein said information about said lighting program includes information indicating specific items of non transitory computer readable media items that are stored in said lighting device.

4. The device as in claim 3, wherein said assisting computer part receives other items of non transitory computer readable media items to be stored in said lighting device, said receives being during a time when said lighting device does not have power applied.

5. The device as in claim 3, wherein said wireless communicator accepts messages only when a specified encryption criteria is met for said messages.

* * * * *